US008726775B2

(12) United States Patent
Yamada et al.

(10) Patent No.: US 8,726,775 B2
(45) Date of Patent: May 20, 2014

(54) PUNCHING SCRAP REMOVAL DEVICE AND BLADE MOUNT FOR ROTARY DIE CUTTER

(75) Inventors: Hironari Yamada, Mihara (JP); Osamu Hatano, Mihara (JP)

(73) Assignee: Mitsubishi Heavy Industries Printing & Packaging Machinery, Ltd., Hiroshima (JP)

( * ) Notice: Subject to any disclaimer, the term of this patent is extended or adjusted under 35 U.S.C. 154(b) by 246 days.

(21) Appl. No.: 13/381,627

(22) PCT Filed: Jun. 21, 2010

(86) PCT No.: PCT/JP2010/060468

§ 371 (c)(1),
(2), (4) Date: Dec. 29, 2011

(87) PCT Pub. No.: WO2010/150743

PCT Pub. Date: Dec. 29, 2010

(65) Prior Publication Data

US 2012/0111166 A1 May 10, 2012

(30) Foreign Application Priority Data

Jun. 26, 2009 (JP) ..... 2009-152488

(51) Int. Cl.
*B26D 7/06* (2006.01)
*B26F 1/46* (2006.01)

(52) U.S. Cl.
USPC ..... 83/127; 83/111; 83/653

(58) Field of Classification Search
CPC ..... B26D 7/06; B26F 1/46
USPC ..... 83/653, 111, 123, 127, 128, 129, 134, 83/135
See application file for complete search history.

(56) References Cited

U.S. PATENT DOCUMENTS 646,346 A 3/1900 Batten
1,751,603 A * 3/1930 Sauerman ..... 83/655

(Continued)

FOREIGN PATENT DOCUMENTS

DE 2830414 A1 1/1980
EP 2463069 A1 6/2012

(Continued)

OTHER PUBLICATIONS

International Search Report for PCT/JP2010/060468, dated Sep. 21, 2010.

(Continued)

*Primary Examiner* — Sean Michalski
(74) *Attorney, Agent, or Firm* — Lowe Hauptman & Ham LLP

(57) ABSTRACT

It is intended to improve work efficiency by eliminating the work of attaching and removing push rods during installing and dismounting the a blade mount and also to reduce abrasion of the push rods for pushing punching scrap out of a punching blade. The first push rods 18 are inserted movably in the first through-holes 16 formed in the knife cylinder and the second push rods 36 are inserted movably in the second through-holes 34 formed in the blade mount to permit the second push rods 36 to be abutted on the first push rods 18. A scrap push lever 30 is mounted on the outer end of the second push rod 36 to push out the punching scrap a and an eccentric cylinder 14 is provided inside of the knife cylinder 10 to push the first push rod 18 outward when pushing out the punching scrap a. The stroke of the first push rod 18 is controlled so that the outer end 18*a* of the first push rod 18 does not project from the outer periphery 10*a* of the knife cylinder. The first push rod 18 and the second push rod 36 are preferably made from one of self-lubricating resin and abrasion-resistant material.

13 Claims, 5 Drawing Sheets

(56) References Cited

U.S. PATENT DOCUMENTS

| | | | | | |
|---|---|---|---|---|---|
| 2,327,530 | A * | 8/1943 | Klopfenstein | 83/134 |
| 2,525,987 | A * | 10/1950 | Williamson | 83/117 |
| 3,081,656 | A * | 3/1963 | Freundlich | 83/125 |
| 4,534,248 | A | 8/1985 | Andersson | |
| 5,546,839 | A * | 8/1996 | Gardiner | 83/128 |
| 5,636,559 | A * | 6/1997 | Smithwick et al. | 83/116 |
| 5,782,152 | A * | 7/1998 | Reis et al. | 83/22 |
| 6,152,812 | A * | 11/2000 | Sung et al. | 451/180 |
| 6,305,209 | B1 * | 10/2001 | Suzuki et al. | 72/328 |
| 6,644,153 | B1 * | 11/2003 | Gordon | 83/27 |
| 6,925,918 | B1 * | 8/2005 | Bunge | 83/116 |
| 7,415,914 | B2 * | 8/2008 | Irwin | 83/365 |
| 7,565,855 | B2 * | 7/2009 | Malke et al. | 83/86 |
| 8,127,649 | B2 * | 3/2012 | Holliday | 83/109 |
| 8,166,858 | B2 * | 5/2012 | Luquette | 83/115 |
| 8,215,148 | B2 * | 7/2012 | Fujimura et al. | 72/344 |
| 2001/0002692 | A1 * | 6/2001 | McPherson | 248/228.7 |
| 2011/0283548 | A1 * | 11/2011 | White | 30/301 |

FOREIGN PATENT DOCUMENTS

| | | | |
|---|---|---|---|
| JP | 5718996 | | 1/1982 |
| JP | 199599 | | 7/1989 |
| JP | 215895 | | 1/1990 |
| JP | 473499 | | 6/1992 |
| JP | 720294 | U | 4/1995 |
| JP | 10315199 | A | 12/1998 |
| JP | 2000158389 | A | 6/2000 |
| JP | 2005007543 | A | 1/2005 |

OTHER PUBLICATIONS

Notification of Reason(s) for Rejection corresponding Japanese application No. 2009-152488, Jun. 25, 2013.

International Search Report for PCT/JP2010/060468, dated Jan. 17, 2012.

Office Action mailed Oct. 24, 2013, corresponds to Chinese patent application No. 201080028561.2.

Decision to Grant a Patent mailed Dec. 3, 2013, corresponds to Japanese patent application No. 2009-152488.

Extended European Search Report dated Jan. 23, 2014, corresponds to European patent application No. 10792061.3.

* cited by examiner

Related Art

Related Art

PUNCHING SCRAP REMOVAL DEVICE AND BLADE MOUNT FOR ROTARY DIE CUTTER

RELATED APPLICATIONS

The present application is a National Phase of International Application Number PCT/JP2010/60468, filed Jun. 21, 2010 and claims priority from, Japanese Application Number 2009-152488, filed Jun. 26, 2009.

TECHNICAL FIELD

The present invention relates to punching scrap removal device and a blade mount for a rotary die cutter which can shorten the process for mounting or dismounting the blade mount for a knife cylinder in the case of punching a processed material by the rotary die cutter used to process a corrugated cardboard or the like.

BACKGROUND ART

In the production of corrugated cardboard boxes, the rotary die cutter processes a printed corrugated cardboard sheet for ruling and punching. The rotary die cutter includes an anvil cylinder and a knife cylinder which are juxtaposed to each other. In the punching process, a circular die board with a punching blade is installed around an outer periphery of the knife cylinder. The anvil cylinder and the knife cylinder are rotate in the opposite direction so that a sheet to be processed is fed to the cylinders where the sheet is punched out into a predetermined shape.

In the punching process, the punching scrap tends to stay between the punching blades. The punching scrap must be removed at a prescribed position to avoid scattering of the scrap.

Patent Document 1 (JP2005-7543A) and Patent Document 2 (JP2000-158389A) disclose devices for removing punching scrap for a rotary die cutter. The device disclosed in Patent Document 1 is described below in reference to FIG. 6 and FIG. 7.

In FIG. 6 and FIG. 7, the rotary die cutter 100 includes the anvil cylinder 102 and the knife cylinder 104. Both of the cylinders 102 and 104 rotate in the direction indicated with arrows in FIG. 6. The circular blade mount 106 is detachably installed around the outer periphery of the knife cylinder 104 by means of bolts or the like. The blade mount 106 includes a punching blade 108 for punching out the sheet S to be processed such as a corrugated cardboard sheet being fed between the cylinders 102 and 104 into a predetermined shape and holding teeth 110 for holding the punch scrap a from punching the sheet S by the punching blade 108.

A scrap dropping arm 112 is provided swingably around a support pin 114 on the outer periphery of the blade mount 106. The scrap dropping arm 112 has a notched portion 116 at a tip thereof so that the holding teeth can be inserted therein. A coil spring 118 is provided near the scrap dropping arm 112 and supported on a hinge member 120. A pressing piece 122 of the coil spring 118 is abutted on a surface of the scrap dropping arm 112 so as to press the scrap dropping arm 122 inwardly.

The knife cylinder 104 and the blade mount 106 have a plurality of through-holes 126 drilled therein in the radial direction. Each through-hole 126 has a push rod 130 inserted therein and covered by the scrap dropping arm 112. The push rod 130 is in contact with an outer periphery of an eccentric cylinder 132 which is installed inside of the knife cylinder 104. The eccentric cylinder 132 has a rotation center which is eccentric with respect to the center of the knife cylinder 104. The rotation of the eccentric cylinder 132 pushes the push rod 130 outwardly in the radial direction.

As shown in FIG. 6, the anvil cylinder 102 and the knife cylinder 104 rotate in the direction indicated with the arrows to feed the sheet S through the cylinders 102 and 104. The punching blade 108 mounted on the blade mount 106 forms a punching line on the sheet S. Inside of the punching line is a product part and outside of the punching line is punching scrap a. The product part is pushed out from the punching blade 108 by means of a spring member which is provided inside the punching blade 108 but not shown. The punching scrap a is held by the holding teeth 110 and transferred in the circumferential direction of the knife cylinder 104.

When the punching scrap a reaches a bottom part of the knife cylinder 103, the push rod 130 moves outwardly in the radial direction by the rotation of the eccentric cylinder 132. The scrap dropping arm 112 is swung outwardly to drop the punching scrap a from the holding teeth 110.

The push rod 130 is installed or removed by turning the scrap dropping arm 112 into the upright position. When the scrap dropping arm 112 is turned into the upright position, a stopper 124 and the pressing piece 122 mounted on a coil spring 118 are abutted on each other to inhibit the scrap dropping arm 112 from being turned more than need.

The punching scrap a needs to be pushed out at a predetermined position so as not to scatter the punching scrap which can interfere with operation of the rotary die cutter and cause the punching scrap to get in the product.

Patent Document 2 (JP2000-158389A) also discloses a punching scrap removal device, which has a pair of the rotary die cutters, each consisting of the anvil cylinder and the knife cylinder, installed in the traveling direction of the sheet to be processed. The rotary die cutter on the upstream side punches the sheet and the other rotary die cutter on the downstream side removes the punching scrap held in the punching blade.

CITATION LIST

Patent Literature

[PATENT DOCUMENT 1] JP2005-7543A
[PATENT DOCUMENT 2] JP2000-158389A

SUMMARY OF INVENTION

Technical Problem

In the conventional punching scrap removal device disclosed in Patent Document 1, the through-holes for the push rods are provided across the periphery of the knife cylinder with a set distance. To install the blade mount, the push rods are inserted in the through-holes that correspond to the configuration of the blade mount. After performing the punching process, the inserted push rods are removed and then the blade mount is dismounted.

As described above, the position of the through-holes into which the push rods are inserted is not uniform and depends on the configuration of the blade mount. For each installation of the blade mount, many push rods are frequently installed or removed. This takes time and lowers the work efficiency. In the case where the lower end of the push rod is constantly in contact with the eccentric cylinder, the large amount of eccentricity causes the push rod to move in a great stroke width, resulting in the abrasion of the push rod.

The punching scrap removal device for the rotary die cutter disclosed in Patent Document 2, requires the pair of rotary die cutter. In addition to the above issue of the abrasion of the push rod, the installation cost increases and a large installation space is required.

In view of the problems of the related art, it is a first object of the present invention to reduce the time for installing and dismounting the blade mount and improve the work efficiency by eliminating the attaching and removing of a plurality of push rods in the process of installing and dismounting the blade mount in the punching scrap removal device for the rotary die cutter.

Another object of the present invention is to reduce the abrasion of the inner end of the push rod which slidingly contacts the pushing unit such as the eccentric cylinder.

Solution to Problem

To achieve the above objects, the present invention provides a punching scrap removal device for a rotary die cutter which includes a knife cylinder, an anvil cylinder arranged in contraposition to the knife cylinder, and a blade mount installed on an outer periphery of the knife cylinder with a punching blade, the blade mount having an arc-shaped cross-section, the punching blade punching a sheet to be processed that is passed between the knife cylinder and the anvil cylinder. The punching scrap removal device may include, but is not limited to: a plurality of first push members which are movably installed in a plurality of first through-holes respectively, the first through-holes being formed in an outer wall of the knife cylinder; a plurality of second push members which are movably installed in a plurality of second through-holes respectively, the second through-holes being formed in the blade mount at face-to-face positions with the first through-holes of the knife cylinder, the second push members being permitted to be abutted on the first push members respectively; and a pushing unit which is provided inside of the knife cylinder and pushes the first push members outwardly. The second push members are moved outwardly by the pushing unit to push out punching scrap which remains in the punching blade after punching the sheet. The stroke of the first push members is controlled so as to keep outer ends of the first push members within the outer periphery of the knife cylinder.

In the device of the present invention, the first push members are installed in advance in the first through-holes formed in the knife cylinder and the second push members are installed in advance in the first through-holes formed in the blade mount.

Next, the blade mount is installed on the knife cylinder. Then, the first push members and the second push members are arranged in such a manner that the first and second push members are abutted on each other. The pushing unit pushes the second push members outward via the first push members so as to remove the punching scrap held in the punching blades.

The first and second push members are installed in advance in substantially all of the first and second through-holes so as to eliminate the need for installing or removing the first and second push members in the process of installing and dismounting the blade mount.

As a result, it is possible to reduce the work of inserting and removing the first and second push members in the process of installing and dismounting the blade mount and also to significantly reduce the time required for mounting and dismounting the blade mount.

The pushing unit may be, for instance, one of an eccentric rotating unit which has a rotation center eccentric to a rotation center of the knife cylinder and has a cylindrical outer periphery and a cam which has a cam axis in the rotation center of the knife cylinder. The pushing unit pushes the first push member toward the knife cylinder by one of the eccentric rotating unit and the cam.

In the device of the present invention, the stroke of the first push member is controlled so that outer end of the first push member is always kept form protruding from the outer periphery of the knife cylinder. Thus, during the installing and dismounting of the blade mount, the first push member does not contact the inner periphery of the blade mount. This prevent the first push member from getting in the way of installing and dismounting the blade mount.

It is preferable that the device of the present invention further include a scrap push lever which is fixed to an outer end of the second push member. The scrap push lever gas one end that is supported rotatably on an outer surface of the blade mount and the other end that is inserted inside the punching blade through an aperture formed in the punching blade. The other end of the scrap push lever pushes out the punching scrap. The stroke of the second push members is controlled by an opening width of the aperture of the punching blade.

By this, the structure of the push members is simplified, and the pushing force applied to the scrap push lever by the second push member as well as the stroke of the inserted tip of the scrap push lever can be controlled by adjusting the distance between the axial support point of the scrap push lever and the inserted tip and the distance between the axial support point and the installation position of the second push member.

It is also preferable that the device of the present invention further includes a scrap holding blade which is arranged in a space surrounded by the punching blade and holds the punching scrap, the scrap holding blade having an aperture into which a flange part formed on an outer periphery of the second push member is inserted. The stroke of the second push members may be controlled by an opening width of the aperture of the scrap holding blade.

By this, the projection position of the inserted tip of the scrap push lever can be controlled by the opening with of the aperture formed in the punching blade. Thus, it is not necessary to provide a separate regulating unit and the structure of the scrap pushing mechanism can be simplified.

It is also preferable that the device of the present invention further includes a spring member which is provided to apply elastic force to each of the first push members toward a center side of the knife cylinder so as to keep said each of the first push members to be held at an inner end of stroke thereof.

By this, the outer end of the first push member is positively kept from projecting from the outer periphery of the knife cylinder. The push rod is held at the inner end of the stroke so as to positively transmit the pushing force of the pushing unit to the first push member.

It is preferable in the device of the present invention that at least one of an inner end of the first push member in contact with the pushing unit, the outer end of the first push member and an inner end of the second push member is made of one of oilless-lubricating resin and abrasion-resistant material. By this, it is possible to reduce the abrasion of at least one of an inner end of the first push member in contact with the pushing unit, the outer end of the first push member and an inner end of the second push member.

For instance, it is preferable to use self-lubricating resin with small friction coefficient which is called engineering plastic such as polyethylene, polyacetal, polyamide, polybuthylene terephthalate and cast iron.

As another way to reduce the friction, it is preferable to provide a rotary member for reducing abrasion which is installed in one of between the inner end of the first push member and the pushing unit and between the outer end of the first push member and the inner end of the second push member.

As another way to reduce the friction, it is preferable that an area of contact between the inner end of the first push member and the pushing unit is increased so as to reduce load per unit area on the inner end of the first push member and reduce abrasion of the inner end of the first push member.

As yet another way to reduce the friction, it is preferable that the pushing unit is one of the eccentric rotating unit and the cam. One of eccentricity of the eccentric rotating unit with respect to the center of the knife cylinder and stroke by the cam is reduced so as to reduce abrasion of the inner end of the first push rod.

As another way to reduce the friction, it is preferable that one of the inner end and an outer end of the first push rod has one of a spherical shape and a conical shape do so as to reduce the abrasion of the inner end or the outer end.

It is preferable that the device of the present invention further includes a retention member which retains each of the first pushing members movably within each of the first through-holes.

By this, the first push member is kept from dropping out of the blade mount and it is possible to install and remove the blade mount smoothly.

The present invention provides a blade mount for a rotary die cutter which includes a knife cylinder and an anvil cylinder arranged in contraposition to the knife cylinder, the punching blade punching a sheet to be processed that is passed between the knife cylinder and the anvil cylinder. The blade mount may include, but is not limited to: a punching blade which is installed on the blade mount; a plurality of first push members which are movably installed in a plurality of first through-holes respectively, the first through-holes being provided in an outer wall of the knife cylinder; a plurality of second push members which are movably installed in a plurality of second through-holes respectively, the second through-holes being provided in the blade mount at face-to-face positions with the first through-holes of the knife cylinder, the second push members being permitted to be abutted on the first push members respectively; and a pushing unit which is provided inside of the knife cylinder and pushes the first push members outwardly. The second push members may be moved outwardly by the pushing unit to push out punching scrap which remains in the punching blade after punching the sheet.

In the blade mount of the present invention, the second push members are inserted beforehand in the second through-holes formed in the blade mount. Thus, it is possible to reduce the work of inserting and removing the second push members and also to significantly reduce the time for installing and dismounting the blade mount.

It is preferable that the blade mount of the present invention further includes a scrap push lever which is fixed to an outer end of the second push member. The scrap push lever has one end that is supported rotatably on an outer surface of a blade mount body and the other end that is inserted inside the punching blade through an aperture formed in the punching blade. The other end of the scrap push lever pushes out the punching scrap. The stroke of the second push members may be controlled by an opening width of the aperture of the punching blade.

By this, the structure of the second push rod can be simplified and the pushing force applied to the scrap push lever by the second push member as well as the stroke of the inserted tip of the scrap push lever can be controlled by adjusting the distance between the axial support point of the scrap push lever and the inserted tip and the distance between the axial support point and the installation position of the second push member.

It is also preferable that the blade mount of the present invention further includes a scrap holding blade which is arranged in a space surrounded by the punching blade and holds the punching scrap, the scrap holding blade having an aperture into which a flange part formed on an outer periphery of the second push member is inserted and stroke of the second push members is controlled by an opening width of the aperture of the scrap holding blade.

By this, the projection position of the inserted tip of the scrap push lever can be controlled by the opening with of the aperture formed in the punching blade. Thus, it is not necessary to provide a separate regulating unit and the structure of the scrap pushing mechanism can be simplified.

Advantageous Effects of Invention

According to the punching scrap removal device of the present invention for the rotary die cutter which includes a knife cylinder, an anvil cylinder arranged in contraposition to the knife cylinder, and a blade mount installed on an outer periphery of the knife cylinder with a punching blade, the blade mount having an arc-shaped cross-section, the punching blade punching a sheet to be processed that is passed between the knife cylinder and the anvil cylinder, the punching scrap removal device may include, but is not limited to: a plurality of first push members which are movably installed in a plurality of first through-holes respectively, the first through-holes being formed in an outer wall of the knife cylinder; a plurality of second push members which are movably installed in a plurality of second through-holes respectively, the second through-holes being formed in the blade mount at face-to-face positions with the first through-holes of the knife cylinder, the second push members being permitted to be abutted on the first push members respectively; and a pushing unit which is provided inside of the knife cylinder and pushes the first push members outwardly. The second push members are moved outwardly by the pushing unit to push out punching scrap which remains in the punching blade after punching the sheet. The stroke of the first push members is controlled so as to keep outer ends of the first push members within the outer periphery of the knife cylinder. The first push members are installed in advance in the first through-holes formed in the knife cylinder and the second push members are installed in advance in the first through-holes formed in the blade mount. As a result, it is possible reduce the work of inserting and removing the first and second push members in the process of installing and dismounting the blade mount and also to significantly reduce the time required for mounting and dismounting the blade mount.

Further, the stroke of the first push member is controlled so that outer end of the first push member is always kept form protruding from the outer periphery of the knife cylinder. Thus, during the installing and dismounting of the blade mount, the first push member does not contact the inner periphery of the blade mount. As a result, it is possible to prevent the first push member from getting in the way of installing and dismounting the blade mount.

The blade mount of the present invention may include, but is not limited to: a punching blade which is installed on the blade mount; a plurality of first push members which are movably installed in a plurality of first through-holes respectively, the first through-holes being provided in an outer wall of the knife cylinder; a plurality of second push members which are movably installed in a plurality of second through-holes respectively, the second through-holes being provided in the blade mount at face-to-face positions with the first through-holes of the knife cylinder, the second push members being permitted to be abutted on the first push members respectively; and a pushing unit which is provided inside of the knife cylinder and pushes the first push members outwardly. The second push members may be moved outwardly by the pushing unit to push out punching scrap which remains in the punching blade after punching the sheet. By this, the second push members can be inserted beforehand in the second through-holes formed in the blade mount. As a result, it is possible to reduce the work of inserting and removing the second push members and also to significantly reduce the time for installing and dismounting the blade mount.

DESCRIPTION OF EMBODIMENTS

Figure 1A:
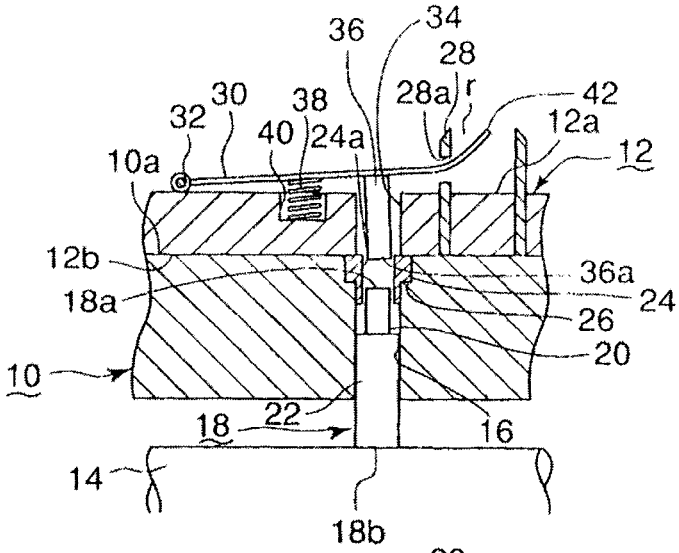
FIG. 1A, FIG. 1B and FIG. 1C are longitudinal-sectional views of a device of a first preferred embodiment of the present invention.

A preferred embodiment of the present invention will now be described in detail with reference to the accompanying drawings. It is intended, however, that unless particularly specified, dimensions, materials, shape, its relative positions and the like shall be interpreted as illustrative only and not limitative of the scope of the present invention.

First Preferred Embodiment

A first preferred embodiment of the present invention is explained in reference to FIG. 1. FIG. 1 is a longitudinal-sectional view of a part of a knife cylinder of the first preferred embodiment. FIG. 1 illustrates the knife cylinder 10 and a wooden blade mount 12 which is installed to cover an outer periphery 10*a* of the knife cylinder 10*a* by means of unshown fixing members such as bolts. The blade mount 12 is shaped into an arc. Inside of the hollow knife cylinder 10, an eccentric cylinder, an eccentric cylinder 14 is arranged parallel to a longitudinal axis direction of the knife cylinder. The eccentric cylinder 14 has a rotation center which is eccentric with respect to a rotation center of the knife cylinder 10. The rotation of the knife cylinder 10 pushes the eccentric cylinder 14 outwardly in the radial direction of the knife cylinder 10. Then, the eccentric cylinder 14 pushes a first push rod 18 outward in the radial direction. The first push rod 18 is described later in details.

A plurality of first through-holes 16 are formed in an outer wall of the knife cylinder 10. The first through-holes 10*a* are disposed at a predetermined interval substantially in the area of the outer wall 10*a*. Substantively, the first push rods 18 are installed in all of the first through-holes 16 in advance. The first through-holes 16 are arranged, for instance, at an interval of 50 mm and can be used for various types of the blade mount. The first push rod 18 has a cylindrical shape and consists of a small-diameter part 20 and a large-diameter part 22. The small-diameter part 20 and the large-diameter part 22 respectively form an upper part and a lower part of the first push rod 18. The large-diameter 22 is loosely fit in the first through-hole 16 and the first push rod 18 is permitted to move upward and downward freely in the first through-hole 16. The first push rod 18 is made of self-lubricating resin such as cast nylon.

A cylindrical screw stopper 24 is provided at an outer end of the first through-hole. The screw stopper 24 has a through-hole 24*a* in the center. The small-diameter part 20 of the first push rod is provided freely movably in the through-hole 24*a*. The screw stopper 24 has a stepped portion 26 on its outer periphery. An increased-diameter part of the screw stopper is threaded so as to be screwed into a threaded hole formed in the first through-hole 16. The large-diameter part 22 stopped by the screw stopper 24 so as to prevent the first push rod 18 from coming out of outer opening of the first through-hole 16.

The blade mount 12 has a punching bladed 28 embedded therein. The punching blade 28 is shaped to enclose a set punching space r. The sheet to be processed such as a corrugated cardboard sheet is fed through an anvil cylinder and the knife cylinder 10 to perform the punching process of the sheet by the punching blade 28. A scrap push lever 30 is provided on an outer periphery 12*a* of the blade mount 12. The scrap push lever 30 is pivotally supported on the outer periphery 12*a* such that the scrap push lever 30 is pivotable around a support shaft 32. The other end of the scrap push lever 30 is inserted in the space r through an aperture 28*a* provided in the punching blade 28 and curves outwardly.

The blade mount 12 has a plurality of second through-holes 34 in the radial direction at face-to-face positions with the outer-side opening of the first through-holes 16. A second push rod is fixed to a rear surface of the scrap push lever 30. The second push rod 36 is inserted in each of the second through-holes 34. A coil spring 38 is provided on a rear side of the scrap push lever 30. The coil spring 38 is housed in a concave portion 40 of a cylindrical shape formed on the outer periphery 12*a* of the blade mount 12. During the installing and dismounting of the blade mount 12 (unloaded condition), the scrap push lever 30 touches a top edge of the aperture 28*a* by the elastic force of the coil spring 38 and an inserted tip 42 of the scrap push lever 30 protrudes slightly above the tip of the punching blade 28. This prevents the second push rod 36 from getting in the way of installing the blade mount 12.

The eccentric cylinder 14 is arranged such that a rotation axis thereof is disposed with respect to the rotation axis of the knife cylinder 10 by 10 mm in a vertical direction. This increases the stroke of the eccentric cylinder 14 to 20 mm. The inner end 18*b* of the first push rod 18 is constantly in contact with the outer periphery of the eccentric cylinder. The first push rod 18 is configured so that the outer end 18*a* of the first push rod 18 does not project from the outer periphery 10*a* of the knife cylinder 10.

Figure 1B:
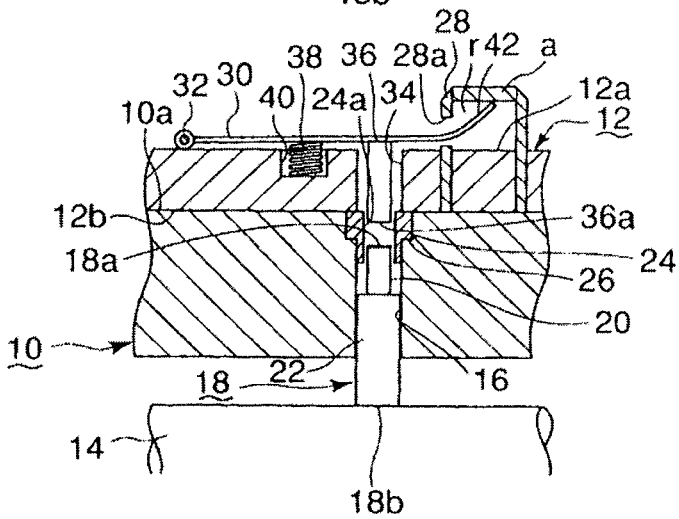
Figure 1C:
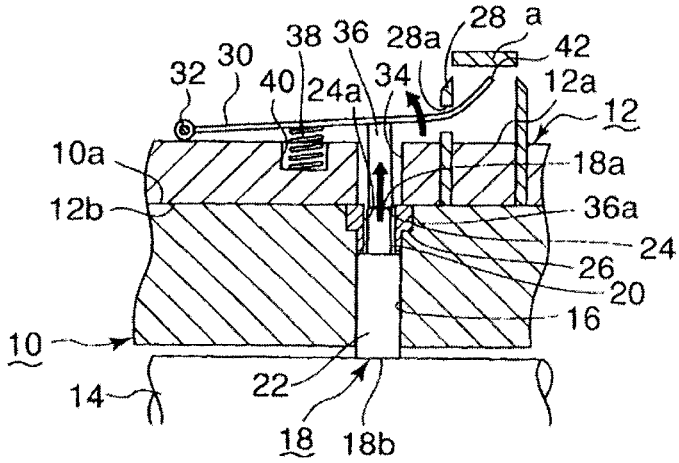

With such structure, FIG. 1A illustrates the installing and dismounting of the blade mount 12, FIG. 1B illustrates the punching of the sheet and FIG. 1C illustrates the pushing-out of the punching scrap. As shown in FIG. 1B, the punching process of the sheet to be processed is performed by the anvil cylinder unshown in the drawing and the knife cylinder 10. After the punching process is performed, the punching scrap a remains in the inside space r of the punching blade in such a state that the punching scrap a is held by the punching blade 28. The elastic force of the coil spring 38 is set not strong enough to push out the punching scrap a held in the punching blade 28 from the punching blade 28.

As shown in FIG. 1C, after the punching process, the knife cylinder 10 rotates to push the eccentric cylinder outward and the eccentric cylinder 14 moves the first push rod 18 upward. Then, the outer end of the first push rod 18 gets in contact with the inner end 36*a* of the second push rod 36 to push the second push rod 36 outward of the blade mount 12, By this, the scrap push lever 30 is pushed outward of the blade mount 12 to push out the punching scrap a from the punching blade 28 by the inserted tip 42 of the scrap push lever 30.

According to the preferred embodiment, the first push rods 18 are installed in almost all of the first through-holes 16 in advance. And, the second push rods 36 are inserted in the second through-holes 34 formed in the blade mount 12 in advance. Thus, during the installing and dismounting of the blade mount 12, the first and second push rods 18 and 36 do not have to be installed in or removed from the first and second through-holes. As a result, it is possible to significantly reduce the time required for installing and dismounting the blade mount 12.

It is configured such that the outer end 18*a* of the first push rod 18 does not project from the outer periphery 10*a* of the knife cylinder. This does not get in the way of installing or dismounting the blade mount 12.

The position of the inserted end 42 of the scrap push lever 30 is regulated by the opening width of the aperture 28*a* formed in the punching blade 28. Thus, the structure of a scrap push-out mechanism can be simplified.

The screw stopper 24 is provided at the outer-side opening of the first through-hole 16 and the large-diameter part 22 of the first push rod 18 is stopped by the screw stopper 24. Thus, it is possible to firmly prevent the first push rod 18 from coming out.

The inner end 18*b* of the first push rod 18 is formed into the large-diameter part 22. Thus, it is possible to reduce the load per unit area on the first push rod 18 from the eccentric cylinder 14. This reduces the abrasion of the inner end 18*b*. Further, the first push rod 18 is made of self-lubricating resin, which significantly reduces the abrasion of the inner end 18*b* and the outer end 18*a* of the first push rod 18 in comparison with the conventional case.

The eccentric amount of the eccentric cylinder 14 with respect to the rotation center of the knife cylinder 10 may be reduced to reduce the abrasion of the inner end 18*b* of the first push rod 18.

Second Preferred Embodiment

Figure 2:
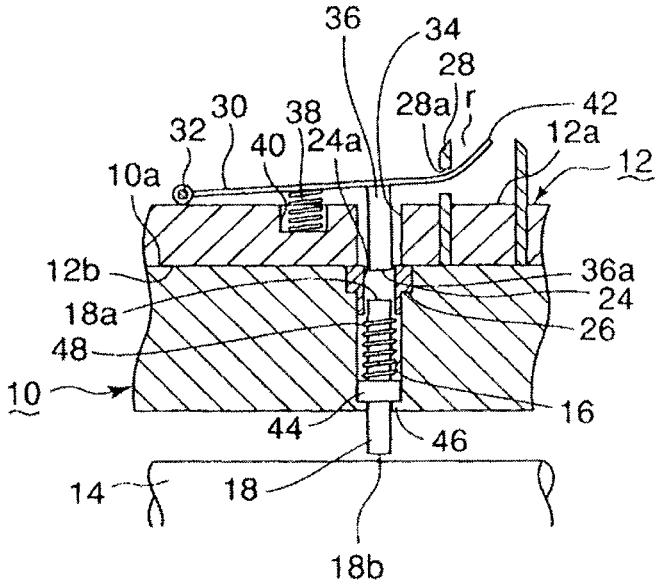
FIG. 2 is a longitudinal-sectional view of a device of a second preferred embodiment of the present invention.

A second preferred embodiment of the present invention is explained in reference to FIG. 2. The second preferred embodiment is a modified example of the first preferred embodiment. FIG. 2 shows parts and devices with the same number as those shown in FIG. 1 and these parts and devices have the same structure and thus are not explained further. FIG. 2 shows a flange part 44 formed in a middle section of the first push rod 18. The flange part 44 is cylindrical in cross-section and has an increased diameter compared to the rest of the first push rod 18. Meanwhile, the first through-hole 16 has a reduced diameter part 46 at the inner-side opening. When the flange part 44 moves downward, the flange part 44 is stopped at the reduced diameter part 46 of the first through-hole 16. The inner end of the stroke of the first push rod 18 is regulated by the position of the position where the flange part 44 is stopped.

A coil spring 48 is provided in the first through-hole 16 between the lower end of the screw stopper and the flange part 44 such as to surround the first push rod 18. The coil spring 48 applies elastic force in the direction to push the flange part 44 toward the eccentric cylinder 14. Thus, except for the time to push out the punching scrap a, the first push rod 18 is stopped at the reduced diameter part 46.

The operation process of the punching scrap removal device in relation to the preferred embodiment is the same as the first preferred embodiment shown in FIG. 1A through FIG. 1C.

According to the preferred embodiment, in addition to the beneficial operational effects which can be obtained by the first preferred embodiment, the flange part 44 is kept pressed against the reduced diameter part 46 by the elastic force of the coil spring 48 expect for the time to push out the punching scrap a. Thus, the movement of the eccentric cylinder 14 can be positively transmitted to the scrap push lever 30.

Third Preferred Embodiment

A third preferred embodiment of the present invention is explained in reference to FIG. 3. FIG. 3 shows parts and devices with the same number as those shown in FIG. 1 and these parts and devices have the same structure and thus are not explained further. FIG. 3 shows a scrap holding blade 50 which is arranged in the inner space r of the punching blade 28. The scrap holding blade holds the punching scrap a which remains in the punching blade 28 after punching. The second push rod 36 has a hat-shaped pushing member 52 fixed to the outer end. The hat-shaped pushing member 52 has a flange part 52*a* having a increased diameter integrally formed on a bottom part of the pushing member 52. The scrap holding blade 50 has an aperture 50*a* into which the flange part 52*a* is inserted.

The second through-hole 34 has a small-diameter part on the outer side and a large-diameter part on the inner side and a stepped part 54 formed therebetween. A coil spring 56 is inserted between the stepped part 54 and a bottom surface of the pushing member 52 such as to surround the second push rod 36. In the preferred embodiment, the axial length of the small-diameter part 20 and the large-diameter part 22 is respectively adjusted so as to prevent the outer end 18*a* of the first push rod 18 from projecting from the outer periphery 10*a* of the knife cylinder 10 when installing and dismounting the blade mount 12.

In the preferred embodiment, the pushing member 52, the coil spring 56 and the scrap holding blade 50 are provided instead of the scrap pushing lever 30 and the coil spring 38 of the first preferred embodiment. The rest of the structure in the second preferred embodiment is the same as the first preferred embodiment.

Figure 3A:
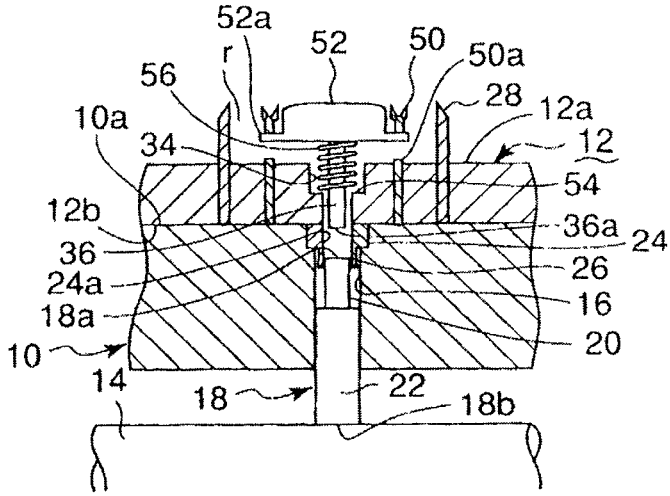
FIG. 3A, FIG. 3B and FIG. 3C are longitudinal-sectional views of a device of a third preferred embodiment of the present invention.
Figure 3B:
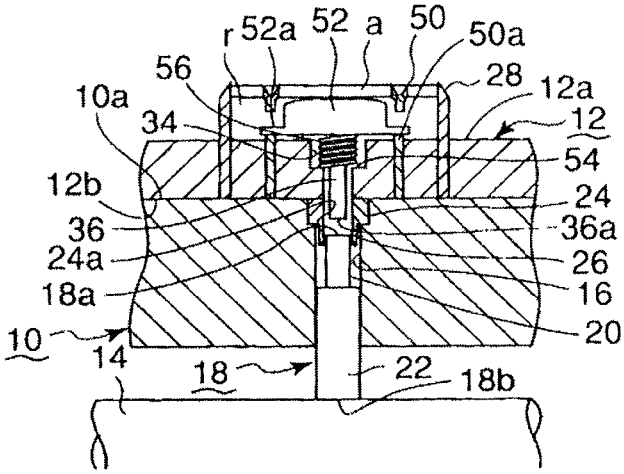
Figure 3C:
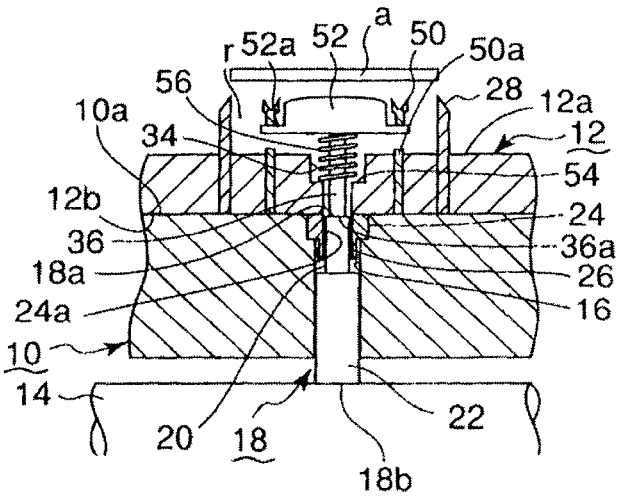

With such structure, FIG. 3A illustrates the installing and dismounting of the blade mount 12, FIG. 3B illustrates the punching of the sheet and FIG. 3C illustrates the pushing-out of the punching scrap.

The movement of the eccentric cylinder 14 pushes the scrap pushing member 52 outward via the first push rod 18 and the second push rod 36. The pushing member 52 moves upward to push out the punching scrap a from the punching blade 50 against the holding force of the punching scrap by the holding blade 50. In this manner, the punching scrap a is pushed out. The stroke of the pushing member 52 is regulated in such a manner that the flange part 52*a* comes in contact with a top edge of the aperture 50*a*.

According to the preferred embodiment, the scrap holding blade 50 is provided. Thus, the holding force of the punching scrap a increases. Further, the stroke of the scrap pushing member 52 which pushes out the punching scrap a remaining in the punching blade 28 is regulated by the opening width of the aperture 50*a* formed in the scrap holding blade 50. Thus, it is possible to simplify the device for pushing out the punching scrap a.

Furthermore, the outer end 18*a* of the first push rod 18 does not project from the outer periphery 10*a* of the knife cylinder. This prevents the first push rod 18 from getting in the way of installing or dismounting the blade mount 12.

In the manner similar to the first preferred embodiment, during the installing and dismounting of the blade mount 12, the first and second push rods 18 and 36 do not have to be installed in or removed from the first and second through-holes respectively. As a result, it is possible to significantly reduce the time required for installing and dismounting the blade mount 12 and also to reduce the abrasion of the inner end 18*b* and the outer end 18*a* of the first push rod 18 and the inner end 36*a* of the second push rod 36.

The modified example shown in FIG. 2 can be applied as a modified example of the preferred embodiment.

Fourth Preferred Embodiment

Figure 4A:
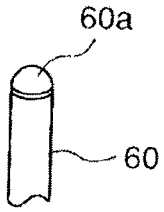
FIG. 4A, FIG. 4B and FIG. 4C are perspective views of a device of a fourth preferred embodiment of the present invention.

Another preferred embodiment of the present invention is explained in reference to FIG. 4. This preferred embodiment is a modified exemplary case of the first push rod 18. FIG. 4A shows a first push rod 60 shaped into a column and has an outer end 60*a* formed into a spherical shape and thus, there is no obstruction causing the first push member and the second push rod 36 to get stuck while being in contact with each other. This reduces the abrasion when abutting the first push rod 60 on the second push rod 36.

Figure 4B:
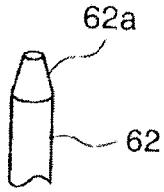

FIG. 4B is another modified exemplary case of the first push rod 18. FIG. 4B shows a first push rod 62 which has a chamfered part 62*a* on the tip. The chamfered part 62*a* tapers toward the tip and has a conical shape so that there is no obstruction causing the first push member and the second push rod 36 to get stuck. This reduces the abrasion when abutting the first push member on the second push rod 62.

Figure 4C:
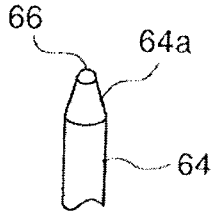

FIG. 4C is another modified exemplary case of the first push rod 18. FIG. 4C shows a first push rod 64 which has a chamfered part 64*a* on the outer end of the first push rod 64. At the tip of the chamfered part 64*a*, formed is a concave portion in which a ball 66 is rotatably fit. The ball 66 has a sphere shape and is made of abrasion-resistant material. By this, when abutting the first and second push rods 64 and 36 on each other, the ball 66 rotates and thus, there is no obstruction between the first push member and the second push rod. This reduces the abrasion of the outer end of the first push member.

Each of the above modified exemplary cases of FIG. 4A to FIG. 4C are applicable to one of the inner end of the first push rod 18 and the outer end of the second push member. This reduces the abrasion of the one of the inner end of the first push rod 18 and the outer end of the second push member.

Fifth Preferred Embodiment

Figure 5:
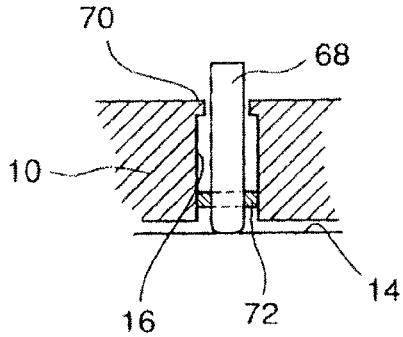
FIG. 5 is a longitudinal-sectional view of a device of a fifth preferred embodiment of the present invention.
Figure 6:
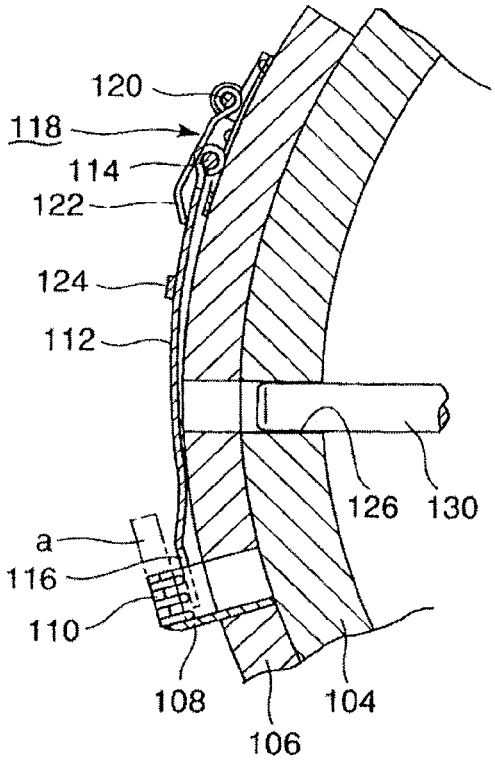
FIG. 6 is a cross-sectional view of a conventional rotary die cutter.
Figure 7:
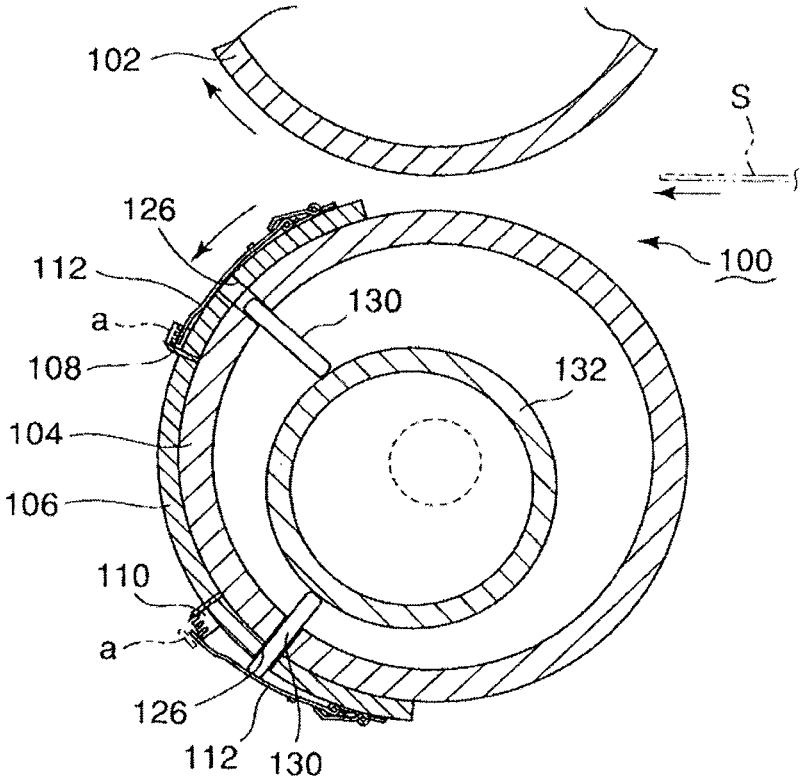
FIG. 7 is an enlarged cross-sectional view of a part of the rotary die cutter of FIG. 6.

FIG. 5 shows another member for preventing the first push rod 68 inserted in the first through-hole 16 from coming out. As shown in FIG. 5, the first through-hole 16 has a reduced diameter part 70 at the outer-side opening of the first through-hole 16. A rubber ring 72 is provided at a bottom part of the cylindrically-shaped first push rod 68. The rubber ring 72 has an internal diameter that is smaller than an external diameter of the first push rod 68. The rubber ring 72 is stretched out and fit onto the bottom part of the first push rod 68. The elastic force of the rubber ring 72 permits the rubber ring 72 to be firmly fixed to the cylindrically-shaped first push rod 68.

The external diameter of the rubber ring 72 is smaller than an internal diameter of the first through-hole 16 so that the first rod 68 is freely movable in the first through-hole 16. The external diameter of the rubber ring 72 is greater than the opening of the reduced-diameter part 70 to prevent the second push rod 68 from coming out of the reduced-diameter part 70. In this manner, it is possible to prevent the first push rod 68 from coming out with a simple device.

In the first to third preferred embodiment shown in FIG. 1 to FIG. 3, the first push rod 16 and the second push member 36 are made of self-lubricating resin to reduce the abrasion thereof. It is also possible to make the first push rod 16 and the second push member 36 of abrasion-resistant material.

For instance, it is possible to use nylon resin such as Cast Nylons (product name of MITSUBOSHI BELTING LTD.), abrasion-resistant resin such as Duracon (product name of Polyplastics Co., Ld.), copper alloy such as phosphor bronze alloy casing, carbon-based material and iron-based such as cast iron.

INDUSTRIAL APPLICABILITY

According to the present invention, it is possible to reduce the time for installing and dismounting the blade mount which is sued for punching process by the rotary die cutter, and also to reduce the abrasion of the push members which removes the punching scrap by the pushing unit pushing out the pushing members.

The invention claimed is:

1. A punching scrap removal device for a rotary die cutter which comprises a knife cylinder, an anvil cylinder arranged in contraposition to the knife cylinder, and a blade mount installed on an outer periphery of the knife cylinder with a punching blade, the blade mount having an arc-shaped cross-section, the punching blade punching a sheet to be processed that is passed between the knife cylinder and the anvil cylinder, the device comprising:

a plurality of first push members which are movably installed in a plurality of first through-holes respectively, the first through-holes being formed in an outer wall of the knife cylinder;

a plurality of second push members which are movably installed in a plurality of second through-holes respectively, the second through-holes being formed in the blade mount at face-to-face positions with the first through-holes of the knife cylinder, the second push members being permitted to be abutted on the first push members respectively; and a pushing unit which is provided inside of the knife cylinder and pushes the first push members outwardly, and a spring member which is provided to apply elastic force to each of the first push members toward a center side of the knife cylinder so as to keep said each of the first push members to be held at an inner end of stroke thereof, wherein the second push members are moved outwardly by the pushing unit to push out punching scrap which remains in the punching blade after punching the sheet, and wherein the stroke of the first push members is controlled so as to keep outer ends of the first push members within the outer periphery of the knife cylinder.

2. The punching scrap removal device for the rotary die cutter according to claim 1, further comprising:

a scrap push lever which is fixed to an outer end of the second push member, the scrap push lever having one end that is supported rotatably on an outer surface of the blade mount and the other end that is inserted inside the punching blade through an aperture formed in the punching blade, the other end of the scrap push lever pushing out the punching scrap, wherein stroke of the second push members is controlled by an opening width of the aperture of the punching blade.

3. The punching scrap removal device for the rotary die cutter according to claim 1, further comprising:

a scrap holding blade which is arranged in a space surrounded by the punching blade and holds the punching scrap, the scrap holding blade having an aperture into which a flange part formed on an outer periphery of the second push member is inserted, and wherein stroke of the second push members is controlled by an opening width of the aperture of the scrap holding blade.

4. The punching scrap removal device for the rotary die cutter according to claim 1, wherein at least one of an inner end of the first push member in contact with the pushing unit, the outer end of the first push member and an inner end of the second push member is made of one of oilless-lubricating resin and abrasion-resistant material.

5. The punching scrap removal device for the rotary die cutter according to claim 1, further comprising:

a rotary member for reducing abrasion which is installed in one of between the inner end of the first push member and the pushing unit and between the outer end of the first push member and the inner end of the second push member.

6. The punching scrap removal device for the rotary die cutter according to claim 1, wherein an area of contact between the inner end of the first push member and the pushing unit is increased so as to reduce load per unit area on the inner end of the first push member and reduce abrasion of the inner end of the first push member.

7. The punching scrap removal device for the rotary die cutter according to claim 1, wherein the pushing unit is one of an eccentric rotating unit which has a rotation center eccentric to a rotation center of the knife cylinder and has a cylindrical outer periphery and a cam which has a cam axis in the rotation center of the knife cylinder, the pushing unit rotating with the knife cylinder and pushing the first push member outwardly, wherein, one of eccentricity of the eccentric rotating unit with respect to the center of the knife cylinder and stroke by the cam is reduced so as to reduce abrasion of the inner end of the first push member.

8. The punching scrap removal device for the rotary die cutter according to claim 1, wherein one of the inner end and an outer end of the first push member has one of a spherical shape and a conical shape.

9. The punching scrap removal device for the rotary die cutter according to claim 1, further comprising:

a retention member which retains each of the first pushing members movably within each of the first through-holes.

10. A blade mount for a rotary die cutter which comprises a knife cylinder and an anvil cylinder arranged in contraposition to the knife cylinder, the punching blade punching a sheet to be processed that is passed between the knife cylinder and the anvil cylinder, the blade mount comprising:

a punching blade which is installed on the blade mount;

a plurality of first push members which are movably installed in a plurality of first through-holes respectively, the first through-holes being provided in an outer wall of the knife cylinder;

a plurality of second push members which are movably installed in a plurality of second through-holes respectively, the second through-holes being provided in the blade mount at face-to-face positions with the first through-holes of the knife cylinder, the second push members being permitted to be abutted on the first push members respectively; and a pushing unit which is provided inside of the knife cylinder and pushes the first push members outwardly, wherein the second push members are moved outwardly by the pushing unit to push out punching scrap which remains in the punching blade after punching the sheet, and wherein stroke of the first and second push members is controlled by an opening width of the aperture of the punching blade.

11. The blade mount for the rotary die cutter according to claim 10, further comprising:

a scrap push lever which is fixed to an outer end of the second push member, the scrap push lever having one end that is supported rotatably on an outer surface of a blade mount body and the other end that is inserted inside the punching blade through an aperture formed in the punching blade, the other end of the scrap push lever pushing out the punching scrap, wherein stroke of the second push members is controlled by an opening width of the aperture of the punching blade.

12. The blade mount for the rotary die cutter according to claim 10, further comprising:

a scrap holding blade which is arranged in a space surrounded by the punching blade and holds the punching scrap, the scrap holding blade having an aperture into which a flange part formed on an outer periphery of the second push member is inserted, and wherein stroke of the second push members is controlled by an opening width of the aperture of the scrap holding blade.

13. The blade mount for the rotary die cutter according to claim 10, wherein the second push members are kept from protruding from a bottom surface of the blade mount when installing and dismounting the blade mount.

* * * * *